United States Patent [19]

Powers et al.

[11] Patent Number: 4,483,750

[45] Date of Patent: Nov. 20, 1984

[54] PROCESS FOR ANODIZING HIGHLY REFLECTIVE ALUMINUM MATERIALS

[75] Inventors: John H. Powers, Lower Burrell; Hang T. Dang, Pittsburgh, both of Pa.

[73] Assignee: Aluminum Company of America, Pittsburgh, Pa.

[21] Appl. No.: 590,323

[22] Filed: Mar. 16, 1984

[51] Int. Cl.[3] ..... C25D 11/04; C25D 11/08

[52] U.S. Cl. ..... 204/29; 204/58

[58] Field of Search ..... 204/58, 29

[56] References Cited

U.S. PATENT DOCUMENTS 3,530,048 9/1970 Darrow ..... 204/58

3,671,333 6/1972 Mosier ..... 204/58

4,252,620 2/1981 Tomita ..... 204/58

*Primary Examiner*—R. L. Andrews

*Attorney, Agent, or Firm*—Andrew Alexander; John P. Taylor

[57] ABSTRACT

An improved process is provided for the production of aluminum reflective material having a higher total reflectance value. The process comprises controlling the anodizing conditions of an aluminum alloy previously subjected to a brightening process by immersing the alloy in a DC anodizing bath containing at least 26 wt. % sulfuric acid and the anodizing sheet at a current density of at least 18 amperes per square foot at a temperature of at least 60° F.

15 Claims, 2 Drawing Figures

PROCESS FOR ANODIZING HIGHLY REFLECTIVE ALUMINUM MATERIALS

BACKGROUND OF THE INVENTION

This invention relates to anodizing aluminum. More particularly, this invention relates to improvements in the anodizing of highly reflective surfaces on aluminum materials.

Highly reflective surfaces may be produced on an aluminum material by proper selection of the alloy constituents, bright rolling or mechanical polishing of the aluminum surface and processing of the highly polished or bright rolled surface in a brightening bath which may comprise either electrobrightening or chemical brightening. The highly reflective surface so produced is then protected by anodizing the aluminum to provide a thin, transparent, protective layer of aluminum oxide on the surface as is well known to those skilled in the art. Various attempts at improving the reflectivity of the product have been proposed through the years. One approach is to vary the type of brightener used to treat the aluminum surface prior to anodizing. Typical of such an approach is the aluminum phosphate chemical brightening bath disclosed in U.S. Pat. No. 3,530,048 which uses a combination of aluminum phosphate, nitric acid, phosphoric acid and copper sulfate. The brightened aluminum surface, according to the patentees, is then anodized in a sulfuric acid bath having a concentration of from 12 to 20 wt. % at a temperature of 70° to 80° F. using a current of about 10 to 15 amperes per square foot.

It is also known to vary the alloy constituents to improve the reflectivity of the aluminum surface. U.S. Pat. No. 3,720,508 discloses an aluminum alloy used in the production of a highly reflective aluminum surface which contains from 0.5 to 3% magnesium, from 0.2 to 0.5% silver, from 0.001 to 0.2% iron and from 0.001 to 0.15% silicon.

It is also known to provide additives in the anodizing bath to attempt to improve the bright or reflective surface of aluminum. For example, U.S. Pat. No. 3,671,333 provides for the addition of a natural or synthetic hydrophilic colloid to the reflective aluminum surface during anodizing of the aluminum by adding the colloid to the anodizing bath. Surface coatings produced during the anodization are alleged to be much thinner and apparently more compact than previous anodized aluminum coatings which the patentees allege is believed to be due to the larger molecule of the colloid forming as a colloidate on the reflective surface which apparently compacts the aluminum oxide formed. The thinner coating is then alleged to provide better reflectivity while eliminating the disadvantages of a thin normal anodized coating.

Other attempts at varying the anodization process include the use of AC anodizing using a sulfuric acid bath as shown in British Pat. No. 1,439,933. High current densities of 1 to 10 amperes per square decimeter (about 10 to 90 amperes per square foot) are proposed in U.S. Pat. No. 4,252,620 for use with a highly concentrated sulfuric acid anodizing bath containing 50 to 60% sulfuric acid and oxalic acid or nickel sulfate to produce a porcelain-like texture although no improvement in reflectivity is alleged or apparently desired by the patentee.

It is, therefore, apparent that little, if any, attempts have been made to improve the reflectivity of an aluminum alloy previously treated in a brightening bath by altering the anodization parameters to maximize the total reflectivity of the anodized aluminum surface of the aluminum material.

SUMMARY OF THE INVENTION

It is, therefore, an object of the invention to provide an improved process for the production of highly reflective anodized aluminum materials.

It is another object of the invention to provide an improved process for the production of highly reflective anodized aluminum materials by optimizing anodization parameters used to provide the anodized finish on the reflective aluminum surface.

It is yet another object of the invention to provide an improved process for the production of a highly reflective anodized aluminum material by providing an improved range of sulfuric acid concentration, current density and temperature range to be utilized during the anodization process.

These and other objects of the invention will be apparent from the description of the preferred embodiment and the accompanying flowsheet.

In accordance with the invention, an improved process for the production of aluminum reflective material having a higher total reflectance value is provided which comprises controlling the anodizing conditions of an aluminum alloy previously subjected to a brightening process by immersing the alloy in a DC anodizing bath containing at least 26 wt. % sulfuric acid and anodizing the sheet at a current density of at least 18 amperes per square foot at a temperature of at least 60° F.

DESCRIPTION OF THE PREFERRED EMBODIMENT

Figure 1:
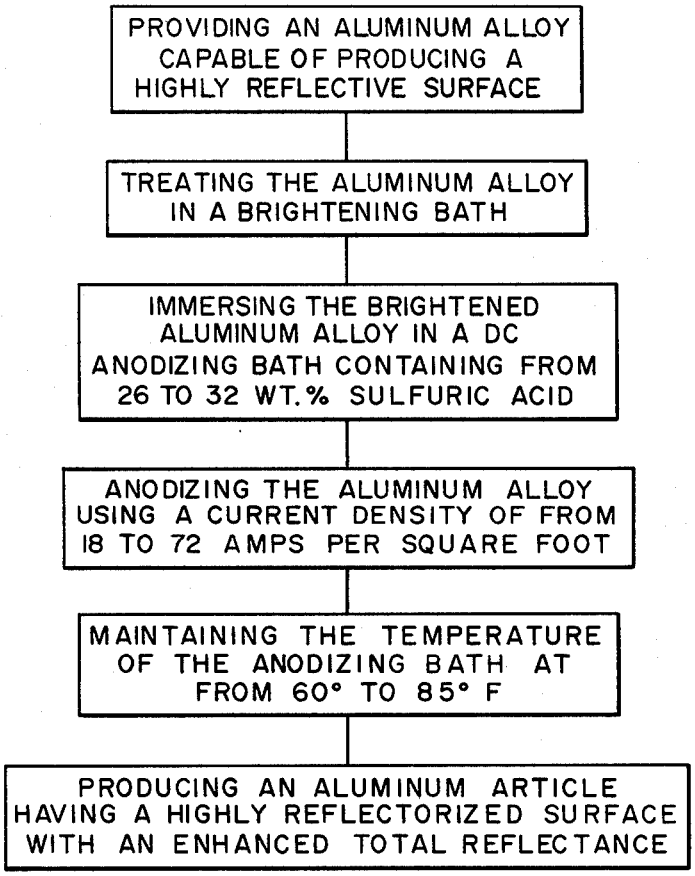
FIG. 1 is a flow sheet illustrating the process of the invention.

In accordance with the invention, an improved anodizing process is provided for the production of highly reflective aluminum material from an aluminum alloy. Conventionally, the alloy is either bright rolled at the plant or else is first mechanically finished or polished to provide a smooth surface. The material is then treated in a brightening bath which may comprise a chemical brightener or an electro brightener. The polished and brightened aluminum surface is then anodized in accordance with the invention to provide the desired highly reflective surface.

Although the process of the invention may be successfully utilized using any of the conventional aluminum alloys normally used in the production of reflectorized aluminum materials, such as aluminum reflector sheet or the like, preferably the aluminum alloy comprises 0 to 2.5% Mg, 0 to 1% Fe, 0 to 0.2% Cu and 0 to 0.2% Mn.

The aluminum alloy material used to form the highly reflective product may comprise as-rolled sheet or may be subjected to any conventional mechanical polishing techniques as are well known to those skilled in the art. The aluminum material is then subjected to a conventional brightening step which may, for example, comprise a chemical brightener, such as the Alcoa 5 chemical brightening which comprises the use of a hot mixture of 85% phosphoric acid and 70% nitric acid which is initially mixed in a 19:1 volumetric ratio, although this ratio will change during use due to accumulation of aluminum phosphate in the solution.

The brightened aluminum surface is then anodized to provide a protective layer of aluminum oxide over the brightened aluminum surface. In accordance with the invention, a sulfuric acid bath is used having a concentration of from 26 to 32 wt. % sulfuric acid, preferably 28 to 32 wt. % sulfuric acid. The temperature of the bath during anodizing is maintained, in accordance with the invention, at from about 60° to 84° F., preferably 67° to 84° F., and most preferably about 73° to 75° F.

The reflective aluminum material is subjected to DC anodizing, i.e. anodizing using direct current with the reflective aluminum material serving as the anode, while maintaining a current density of at least 18 amperes per square foot, preferably from 27 to 72 amperes per square foot, and most preferably, from 30 to 45 amperes per square foot during the time of anodizing.

After anodizing, the reflector material is rinsed in deionized water and the anodized coating is sealed by immersion in hot (95° C.) water or a nickel acetate solution for 5 minutes and then removed and dried. Other, more involved, sealing techniques may be used, but may not be necessary.

The total reflectance of the anodized reflector may then be measured using an integrating sphere type total reflectometer such as Dianos TRI Reflectometer which was used to produce the data in the examples below. Reflective materials, anodized in accordance with the invention, have total reflectance values usually over 80%, and in some instances, over 85%.

The following examples will serve to illustrate the invention.

EXAMPLE I

A number of sheet samples of 5005 type alloy were DC anodized in a sulfuric acid bath following chemical brightening in a hot mixture of 85% phosphoric acid and 70% nitric acid in a 19:1 ratio. Various combinations of acid concentrations, current densities and bath temperatures were used. The results are shown in Table I.

TABLE I

| | Total Reflectance | | | | | |
|---|---|---|---|---|---|---|
| Sample No. | As Run (%) | Corrected Coating[1] Weight (%) | Corrected Coating[1] Thickness (%) | Conc. Acid (%) | C.D. (ASF) | Temp. (°F.) |
| 4 | 81.8 | 82.2 | 82.7 | 28 | 36 | 74 |
| 2 | 81.3 | 81.6 | 82.3 | 28 | 18 | 74 |
| 12 | 81.3 | 81.7 | 81.6 | 22 | 42 | 84 |
| 8 | 80.8 | 80.9 | 81.3 | 28 | 36 | 94 |
| 17 | 80.8 | 81.1 | 81.5 | 22 | 27 | 84 |
| 18 | 80.7 | 81.0 | 81.7 | 22 | 27 | 84 |
| 19 | 80.7 | 81.0 | 81.5 | 22 | 27 | 84 |
| 16 | 80.5 | 80.7 | 81.1 | 22 | 27 | 84 |
| 20 | 80.5 | 80.8 | 81.5 | 22 | 27 | 84 |
| 13 | 80.4 | 80.9 | 80.7 | 22 | 27 | 67 |
| 15 | 80.4 | 80.7 | 80.8 | 22 | 27 | 84 |
| 7 | 80.3 | 80.5 | 80.8 | 16 | 36 | 94 |
| 10 | 80.1 | 80.3 | 80.5 | 32 | 27 | 84 |
| 14 | 79.4 | 79.4 | 79.8 | 22 | 27 | 101 |
| 1 | 79.2 | 79.4 | 79.8 | 22 | 12 | 84 |
| 3 | 79.2 | 79.8 | 80.8 | 16 | 36 | 74 |
| 5 | 79.1 | 79.1 | 79.1 | 16 | 18 | 94 |
| 9 | 79.1 | 79.4 | 79.4 | 12 | 27 | 84 |
| 6 | 79.0 | 78.8 | 79.2 | 28 | 18 | 94 |

TABLE I-continued

| | Total Reflectance | | | | | |
|---|---|---|---|---|---|---|
| Sample No. | As Run (%) | Corrected Coating[1] Weight (%) | Corrected Coating[1] Thickness (%) | Conc. Acid (%) | C.D. (ASF) | Temp. (°F.) |
| 11 | 78.7 | 78.7 | 79.2 | 22 | 12 | 84 |

[1]Since anodizing parameters produced slight differences in coating thickness and weight, reflectance values were corrected to a constant coating thickness or weight.

The above Table I shows the descending order of total reflectance values of the as-processed samples, corrected coating weight and corrected coating thickness values correlated with the processing parameters. Since variations in anodizing parameters cause differences in coating weight or thickness that have a known effect on reflectance, it was necessary to correct the data to a constant coating weight or thickness to eliminate this variable.

It will be seen that, in every instance, where all three parameters were in the range of the invention a total reflectance (uncorrected) of at least 79% was obtained. Furthermore, it will be noted that where one of the parameters is at the low end of the range, this may be compensated for by adjustment of one or both of the other parameters. It will be further noted that when all of the parameters fell within the preferred ranges, the total reflectance was 81.8%.

EXAMPLE II

To further illustrate the process of the invention, a number of samples similar to those used in Example I were brightened as in Example I and then DC anodized in a 32 wt. % sulfuric acid bath at various temperatures and current densities. As shown in Table II, at this acid concentration, every sample had a total reflectance of at least 81.3%.

TABLE II

| Sample No. | C.D. ASF | Temperature °F. | Total Reflectance |
|---|---|---|---|
| 30 | 12 | 67 | 81.3 |
| 21 | 27 | 67 | 81.8 |
| 24 | 30 | 67 | 81.9 |
| 25 | 36 | 67 | 81.8 |
| 26 | 45 | 67 | 82.0 |
| 27 | 54 | 67 | 82.1 |
| 28 | 63 | 67 | 82.0 |
| 29 | 72 | 67 | 82.1 |
| 32 | 30 | 55 | 81.5 |
| 33 | 30 | 60 | 81.5 |
| 34 | 30 | 67 | 81.7 |
| 37 | 30 | 74 | 81.8 |
| 39 | 30 | 84 | 81.8 |

Figure 2:
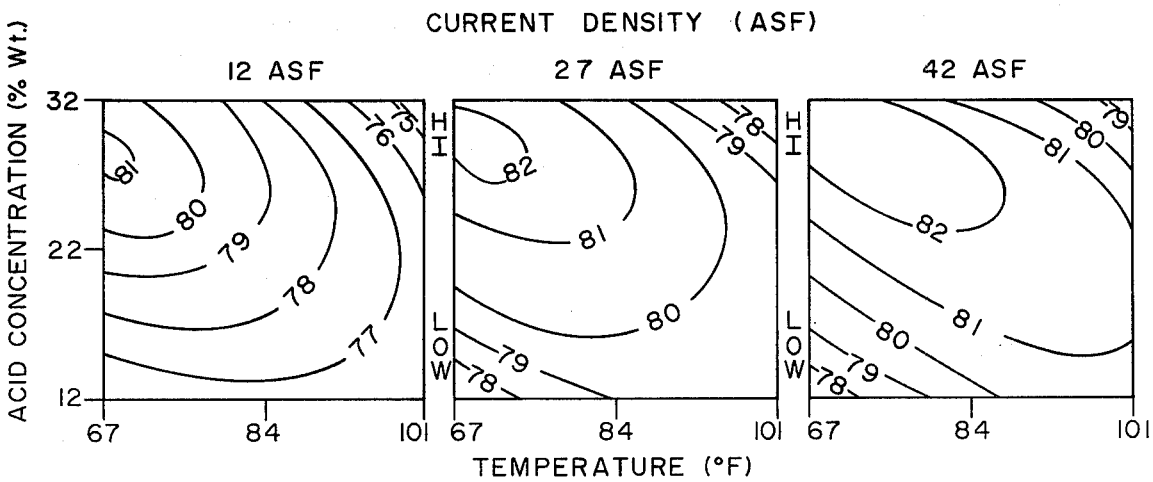
FIG. 2 is a series of contour curves illustrating the interrelationship between the anodizing parameters.

Based on the data produced in Examples I and II, a series of contour curves were developed as shown in FIG. 2 to show the relationship between the three parameters of current density, sulfuric acid concentration and bath temperature to achieve the desired total reflectivity.

Thus, the invention provides an improved process for the production of highly reflective aluminum whereby control and adjustment of the anodizing parameters can be made to maximize the total reflectance of the product.

EXAMPLE III

To illustrate the process of the invention even further, various aluminum alloy compositions were buffed, chemically brightened and anodized using, respectively, conventional anodizing practices, i.e., 15% sulfuric acid, 70° F., 12 amps per square foot for 10 minutes and one embodiments of the improved process of the invention, i.e., 28% sulfuric acid, 74° F. and 42 amps per square foot for 3 minutes. Alloys with and without magnesium having various Fe/Si impurity levels were chosen for the test to illustrate the applicability of the invention to a wide range of alloy compositions that might be considered for aluminum reflectors. As shown in Table III, the process of the invention improved the total reflectance on all of the alloy combinations tested. The table further shows that the amount of improvement increases as the purity of the aluminum is decreased.

TABLE III

| Composition (%) | | | Total Reflectance (%) | |
|---|---|---|---|---|
| Fe | Si | Mg | Conventional | Present Invention |
| 0.45 | 0.10 | 0.7 | 76.4 | 80.8 |
| 0.35 | 0.10 | 0.7 | 78.5 | 82.0 |
| 0.07 | 0.06 | 0.15 | 83.2 | 84.8 |
| 0.05 | 0.04 | 0.8 | 84.1 | 84.9 |
| 0.20 | 0.10 | 0 | 83.1 | 85.0 |
| 0.08 | 0.04 | 0 | 84.4 | 85.5 |
| 0.03 | 0.02 | 0 | 84.8 | 85.8 |

Thus, the invention provides an improved process for the production of highly reflective aluminum whereby control and adjustment of the anodizing parameters can be made to maximize the total reflectance of the product.

Having thus described the invention, what is claimed is:

1. An improved process for the production of aluminum reflector material having a higher total reflectance value, the improvements comprising controlling the anodizing conditions of an aluminum alloy previously subjected to a brightening process, by immersing the alloy in a DC anodizing bath containing at least 26 wt. % sulfuric acid and anodizing the sheet at a current density of at least 18 amperes per square foot at a temperature of at least 60° F.

2. The process of claim 1 wherein said sulfuric acid concentration is from 26 to 32 wt. %.

3. The process of claim 2 wherein said sulfuric acid concentration is from 28 to 32 wt. %.

4. The process of claim 1 wherein said current density is from 18 to 72 amperes per square foot.

5. The process of claim 4 wherein said current density is from 27 to 72 amperes per square foot.

6. The process of claim 5 wherein said current density is from 30 to 45 amperes per square foot.

7. The process of claim 1 wherein said temperature is from 60° to 84° F.

8. The process of claim 7 wherein said temperature is from 67° to 84° F.

9. An improved anodizing process for the production of an anodized aluminum reflector material from an aluminum alloy wherein said anodized aluminum reflector material has an enhanced total reflectance, the improvements comprising:

(a) subjecting the aluminum alloy to a brightening process;

(b) immersing the brightened aluminum material in an anodizing bath containing at least 28 wt. % sulfuric acid;

(c) anodizing said aluminum material in said bath while maintaining a current density of at least 27 amperes per square foot; and (d) maintaining said bath during said anodizing at a temperature of at least 60° F.

10. The process of claim 9 wherein said sulfuric acid concentration is from 28 to 32 wt. %.

11. The process of claim 9 wherein said current density is from 27 to 72 amperes per square foot.

12. The process of claim 11 wherein said current density is from 30 to 45 amperes per square foot.

13. The process of claim 9 wherein said temperature is from 60° to 84° F.

14. The process of claim 13 wherein said temperature is from 67° to 84° F.

15. A process for producing an anodized aluminum reflector material having an enhanced total reflectance from an alloy comprising 0 to 1 wt. % Fe, 0 to 0.2 wt. Cu, 0 to 0.2 wt. % Mn and 0 to 2.5 wt. % Mg which comprises:

(a) brightening the surface of the aluminum material;

(b) immersing the brightened aluminum material in an anodizing bath containing from 26 to 32 wt. % sulfuric acid;

(c) anodizing the aluminum material using a current density of from 18 to 72 amperes per square foot; and (d) maintaining the temperature of the bath during anodizing from 60° to 84° F.

* * * * *